United States Patent [19]

Natale

[11] Patent Number: 4,888,846

[45] Date of Patent: Dec. 26, 1989

[54] ASBESTOS SCRAPER

[75] Inventor: Thomas Natale, Moorestown, N.J.

[73] Assignee: GPAC, Inc., Maple Shade, N.J.

[21] Appl. No.: 144,530

[22] Filed: Jan. 5, 1988

[51] Int. Cl.[4] ..... A47L 13/022; A47L 13/08

[52] U.S. Cl. ..... 15/236.01; 15/143 R; 15/144 R; 15/145

[58] Field of Search ..... 15/143 R, 143 B, 144 R, 15/145, 236 R; 294/1.1, 25, 57, 58; 81/487; 30/169, 296 R, 298, 312, 314, 340, 342, 491; 16/110 R; 7/167

[56] References Cited

U.S. PATENT DOCUMENTS

| | | | |
|---|---|---|---|
| 407,571 | 7/1889 | Calef | 294/58 |
| 496,521 | 5/1893 | Low | 30/298 |
| 712,843 | 11/1902 | Paul | 294/58 |
| 969,528 | 9/1910 | Disbrow | 30/169 |
| 2,482,589 | 9/1949 | Maguire | 294/58 |
| 2,546,113 | 3/1951 | Spang | 294/25 X |
| 3,018,497 | 1/1962 | Echikson | 15/143 |
| 3,154,352 | 10/1964 | Riffelmacher et al. | 306/10 |
| 3,363,316 | 1/1968 | Skarsten | 30/171 |
| 3,562,825 | 2/1971 | Vaughn | 7/14.1 |
| 3,935,425 | 1/1976 | Weissberger et al. | 219/228 |
| 4,009,743 | 3/1977 | Ackerman | 145/1 A |
| 4,355,432 | 10/1982 | Storm, Jr. | 15/245 |
| 4,481,689 | 11/1984 | Westmoreland | 15/236 |
| 4,542,553 | 9/1985 | Cary | 15/236 R |
| 4,549,350 | 10/1985 | Patillo | 30/170 |

*Primary Examiner*—Edward L. Roberts

*Attorney, Agent, or Firm*—Fleit, Jacobson, Cohn, Price, Holman & Stern

[57] ABSTRACT

In an asbestos scraping assembly, the arm of an operator is comfortably cradled in a scraper extension bracket so as to apply greater force to a scraper blade with less effort by the operator than is required of a hand-held scraper blade. The hand of the operator holds a bar of the scraper extension bracket so as to position the area of contact of the scraper blade cutting edge with the surface from which asbestos is to be removed.

20 Claims, 3 Drawing Sheets

FIG. 11
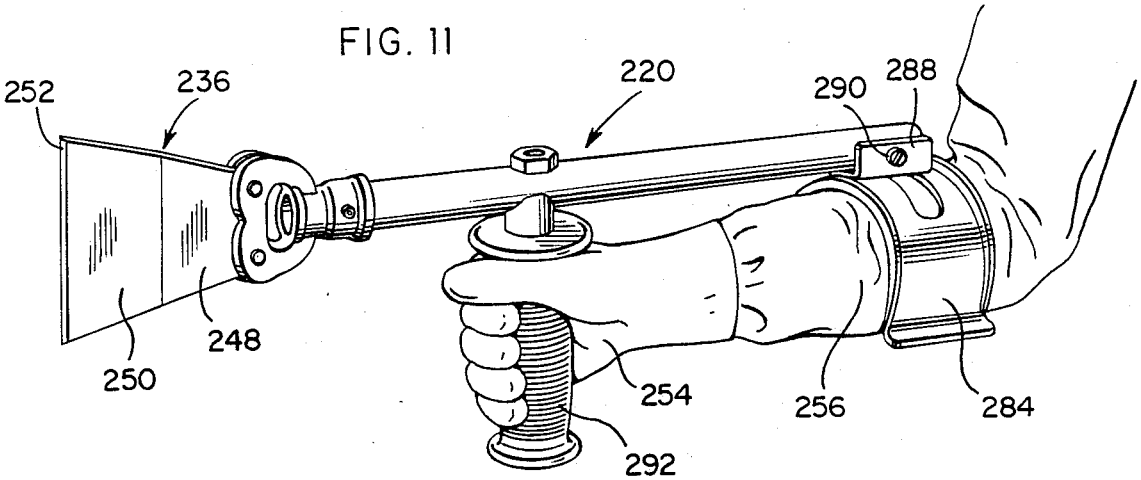
FIG. 12
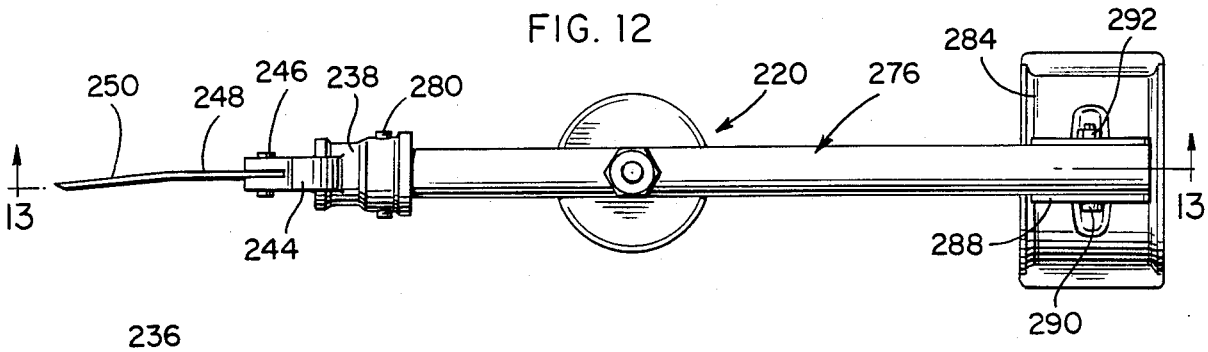
FIG. 13
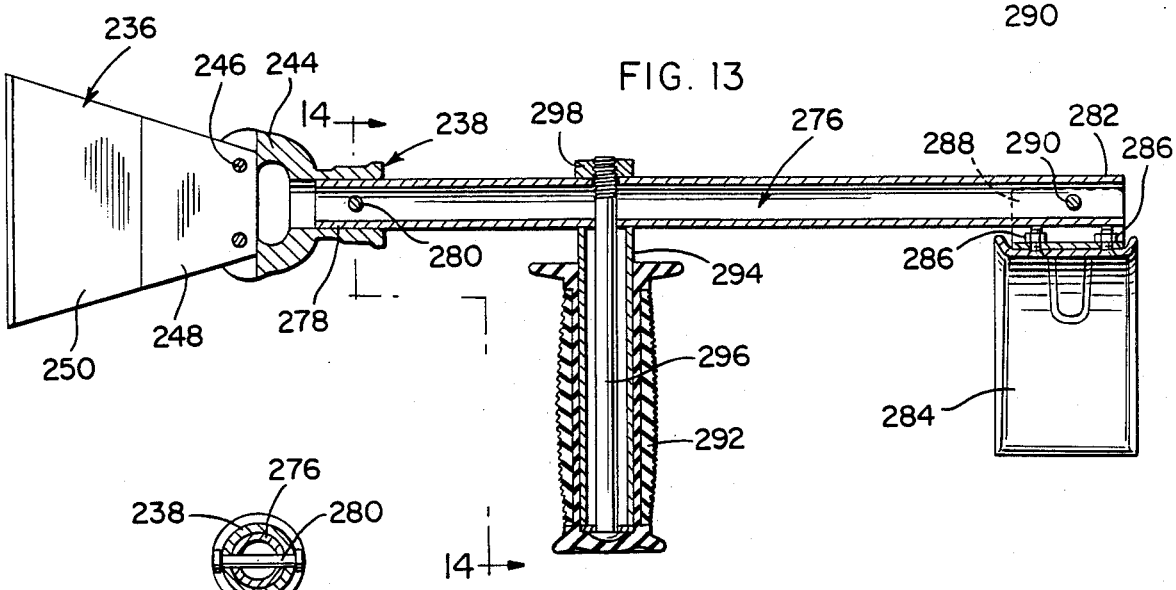
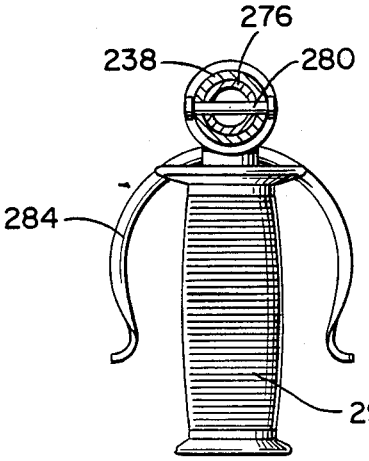
FIG. 14

ASBESTOS SCRAPER

BACKGROUND OF THE INVENTION

This invention relates to an apparatus for the scraping of asbestos from the walls and ceilings of a building, as well as any other asbestos-covered surface. A scraper extension bracket for a scraping blade is supported by the hand and forearm of the operator.

BACKGROUND OF THE INVENTION

During the removal of asbestos-containing waste from an asbestos-covered surface, it is the usual practice to isolate a work area from other sections of a building so as to prevent the spread of asbestos contamination outside of the work area. This can be done in accordance with the method and system set forth in U.S. Pat. No. 4,604,111 to Anthony Natale. In this patent, an enclosure with doorways and decontamination chambers is disclosed with an air intake and at least one filtration unit in air flow communication with the enclosure. The filtration unit includes a blower to pull air into the enclosure and to dispel filtered air to the atmosphere.

High volumes of air flow into the enclosure while a negative air pressure is maintained. By the method and system of this patent, airborne asbestos contamination created during an asbestos removal project is contained within the work area, and the amount of airborne contamination within the work area is reduced so as to produce a comfortable environment to remove asbestos.

Prior practices for the removal of asbestos insulation and asbestos-containing materials from walls and ceiling of an enclosed work area have included the use a hand-held scraper, usually of a width of between 3 to 5 inches. The operator, whether standing on the floor or scaffolding, makes repeated short strokes using hand-applied pressure to scrape asbestos-containing material from the walls, ceilings, pipes, or any other asbestos-covered surface. This method has proven quite tedious and quickly tires the hands and wrist of the operator.

Examples of hand-held scraping tools are found in U.S. Pat. Nos. 3,018,497 to Echikson; 3,562,826 to Vaughn; 4,355,432 to Storm, Jr.; 4,481,689 to Westmoreland; and 4,542,553 to Cary.

SUMMARY OF THE INVENTION

By the present invention, the problems encountered by prior practices for the scraping of asbestos-containing material from walls or ceilings or any other covered surface have been overcome. The present invention incorporates the use of an arm-supported extension bracket which extends from a scraper blade. The entire arm of the operator is comfortably cradled and protected in the bracket so as to allow application of greater force to the scraper blade with less effort by the operator than is required for a hand-held scraper blade. The hand of the operator holds a guide portion of the scraper extension bracket so as to position the area of contact of the scraper blade cutting edge with the surface from which asbestos is to be removed.

It is an object of the present invention to provide a scraper blade for the removal of asbestos which is supported by the hand and arm of an operator.

It is another object of the present invention to provide a scraper blade for the removal of asbestos which is supported by the hand and arm of an operator, where the blade of the scraper is angled so as to concentrate the force of the operator's arm onto the cutting edge of the scraper.

It is yet another object of the present invention to provide a scraper blade for the removal of asbestos which is supported by the hand and arm of an operator, where the blade of the scraper is angled so as to concentrate the force of the operator's arm onto the cutting edge of the scraper and includes an extension bracket for the scraper which can be adjusted to accommodate left- or right-handed operators.

These and other objects of the invention, as well as many of the intended advantages thereof, will become more readily apparent when reference is made to the following description, taken in conjunction with the accompanying drawings.

BRIEF DESCRIPTION OF THE DRAWINGS

FIG. 11 is another embodiment of the asbestos scraper assembly, shown supported by the hand and arm of an operator.

FIG. 12 is a top plan view of the asbestos scraper assembly shown in FIG. 11.

FIG. 13 is a longitudinal section taken along the line 13—13 of FIG. 12.

FIG. 14 is a cross-section, as viewed along the line 14–14 of FIG. 13.

DETAILED DESCRIPTION OF THE DRAWINGS

Figure 1:
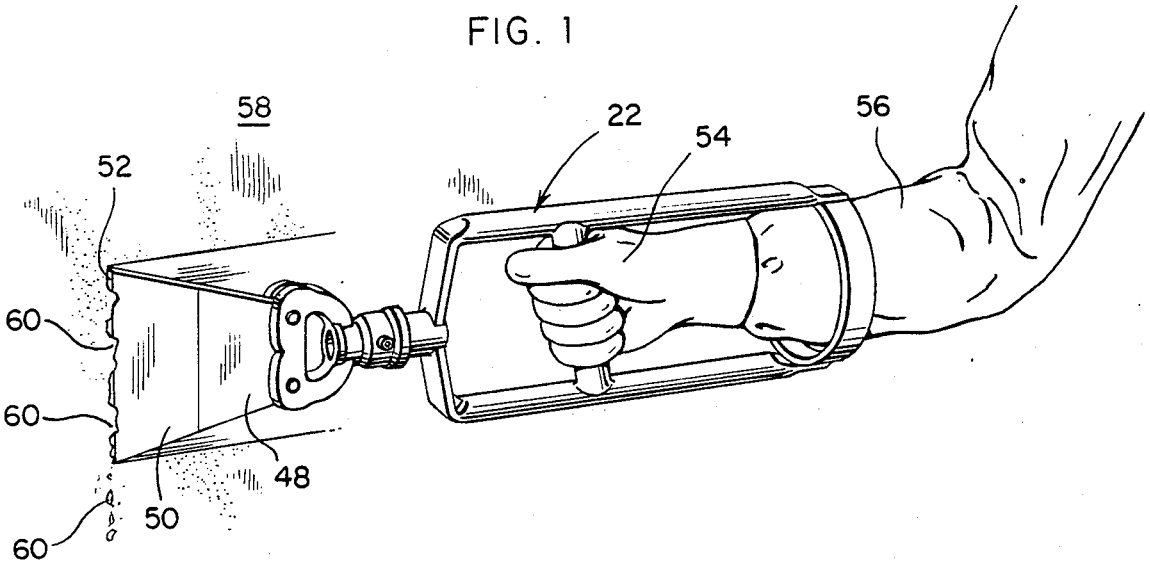
FIG. 1 illustrates an asbestos scraper assembly for scraping asbestos from a flat surface.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 5:
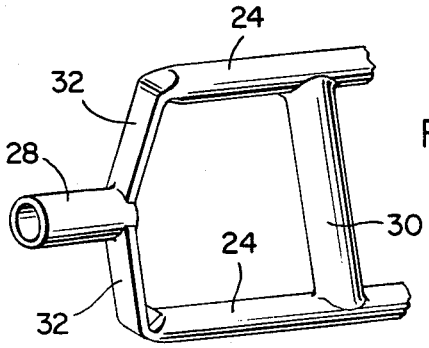
FIG. 5 is a perspective view of one end of the scraper extension bracket.

With reference to the drawings in general, and to FIGS. 1 through 5 in particular, an asbestos scraper assembly embodying the teachings of the subject invention is generally designated as 20. With reference to its orientation in FIG. 2, the scraper assembly includes an extension bracket 22 having parallel crossbars 24. One end of the crossbars 24 terminates in an annular arm ring 26. The other end terminates in tubular extension 28, as shown in FIG. 5. Spanning between parallel crossbars 24 is hand grip bar 30. Bar 30 is inclined at an angle of approximately 10°–15° with respect to the crossbars 24, which forms a comfortable position for cradling the bar 30 in the palm of the hand of an operator.

Tubular member 28 is interconnected with the crossbars 24 by members 32. Members 32 are continuous portions of crossbars 24 and are strengthened by corner piece braces 34. Members 32 are flattened portions of the steel tubes making up crossbars 24.

Scraper blade 36 is secured to tubular member 28 by clamping head 38. Clamping head 38 is hollow, having an interior diameter slightly greater than the exterior diameter of member 28. Two openings 40 are positioned on opposite sides of the clamping head 38. A set screw 42 extends through each opening 40. Each set screw has a hexagonal head recess for receipt of an Allen wrench for tightening of the set screws 42 against the exterior of tubular member 48. Clamping member 38 is thereby secured onto member 28.

Figure 3:
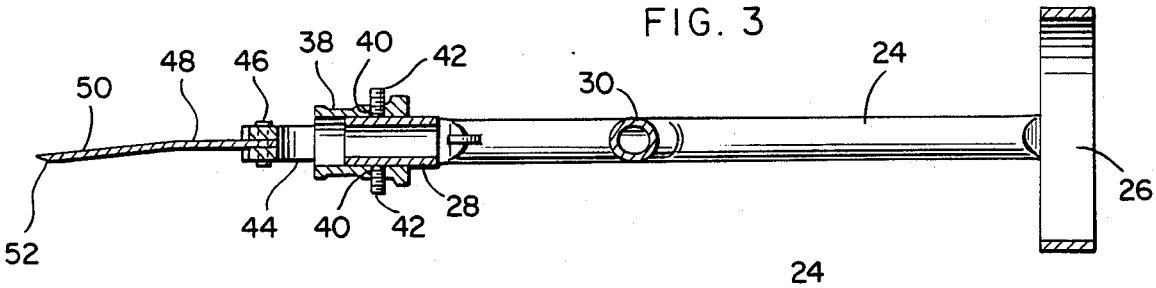
FIG. 3 is an longitudinal section taken along the line 3—3 of FIG. 2.
Figure 4:
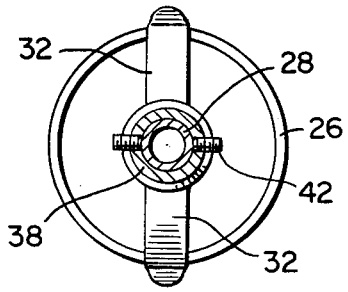
FIG. 4 is a cross-section, as viewed along the line 4—4 of FIG. 2.

An integral portion 40 of clamping head 38 includes two rivets 46, which extend through portion 48 of scraper blade 36. Portion 48 extends in the same plane as crossbars 24, as shown in FIG. 3. Blade section 48 diverges from section 50 by an angle of approximately 15–20°. Extending from an end of blade portion 48, opposite to that end secured by rivets 46 to portion 44, is portion 50 of scraper blade 36 having bevelled scraping or cutting edge 52.

In use, the asbestos scraper assembly is held by the hand and forearm of an operator. The hand 54 passes through annular arm ring 26 so as to cradle bar 30 in the palm of the operator while the fingers surround and hold the bar 30. The forearm 56 of the operator is engaged with the annular arm ring 26 and supports the arm ring during a scraping operation.

To scrape the walls or ceiling or other asbestos-containing surface, the cutting edge 52 of scraper portion 50 contacts the wall, and a force is applied by the operator to push the scraping edge away from the operator. The operator then walks along the surface to be scraped, while pushing the scraping blade ahead of the operator. Asbestos is thereby scraped from the flat wall surface 58 to produce asbestos-containing scrapings 60.

Since scraper portion 50 is located at an angle relative to scraper portion 48, the longitudinal axis of the scraper extension bracket 22 is offset from the plane of scraper portion 50. The scraping edge 52 thereby contacts the flat surface 58, while the arm and body of the operator are spaced away from the wall surface. This avoids scraping of the hand, arm, or body of the operator against the flat surface 58. In prior practices, the hand, especially the knuckles and fingers of the operator, were scraped against a wall during a scraping process due to the proximity of the hand of the operator to the scraping surface and the required scraping angle.

Figure 2:
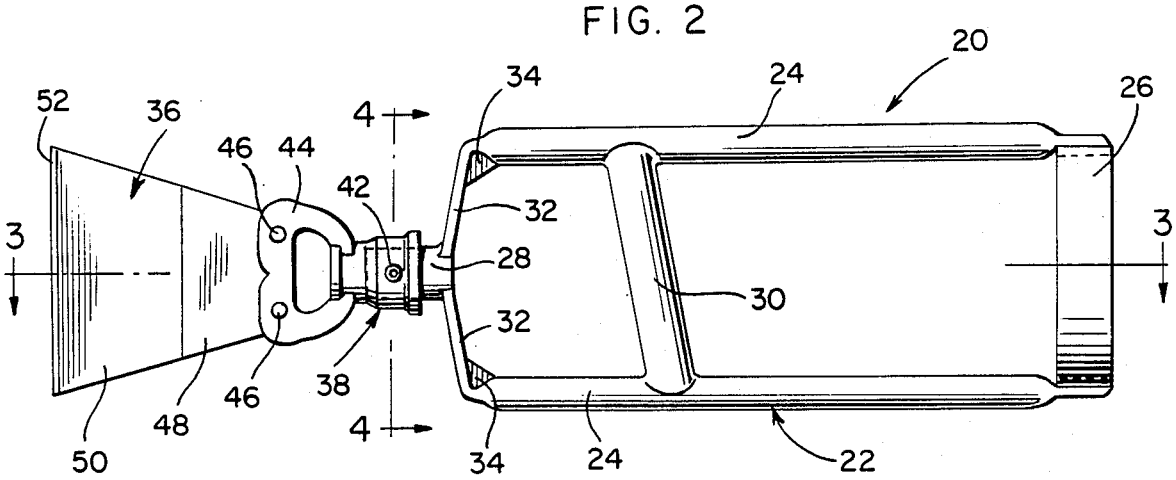
FIG. 2 is an elevational view of the asbestos scraper assembly shown in FIG. 1.

In FIGS. 1 through 3, the scraper blade assembly is shown being used by a right-handed operator. To convert the assembly for use by a lefthanded operator, the set screws 42 are loosened, and the clamping ring 38 is rotated 180°. The set screws 42 are then retightened, and the assembly is available for comfortable use by a lefthanded operator.

In FIGS. 6 through 10, an alternate embodiment of an asbestos scraper assembly is shown. Similar parts to those shown in FIGS. 1 through 5 are denoted with a prefix of 100.

Figure 7:
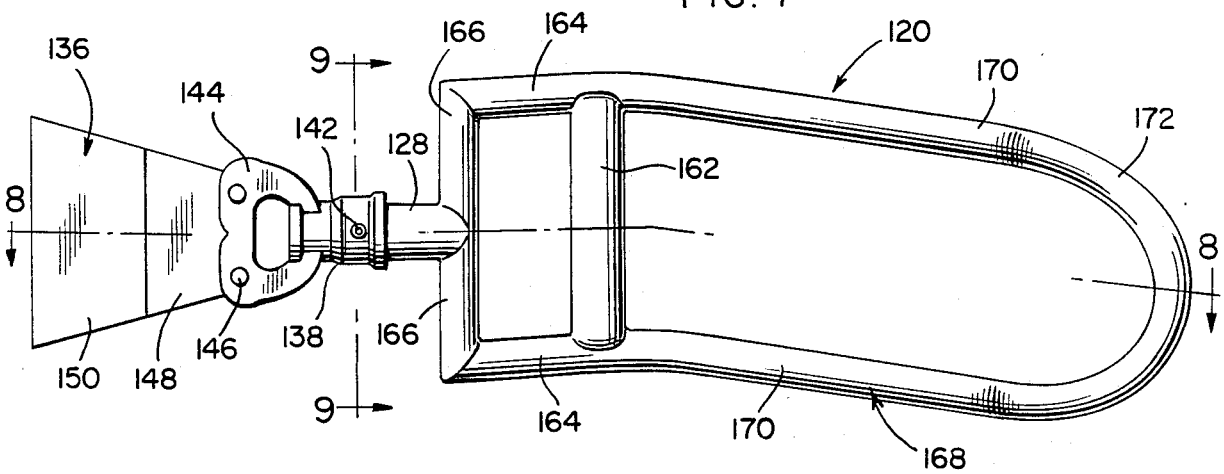
FIG. 7 is a rear side elevation of the asbestos scraper assembly shown in FIG. 6.

In FIG. 7, tubular hand grip bar 162 is located perpendicular to parallel crosspiece sections 164. Parallel crosspiece sections 164 terminate at one end in tubular members 166, which interconnect at tubular member 128. Tubular member 128, as does tubular member 28 in FIGS. 1 through 5, supports clamping ring 138 and scraper blade 136. At the other end of parallel crosspiece sections 164 are the ends of tubular hand grip bar 162. From the hand grip 162 rearward, the scraper extension bracket 120 is of a different configuration than that in FIGS. 1 through 5.

Figure 8:
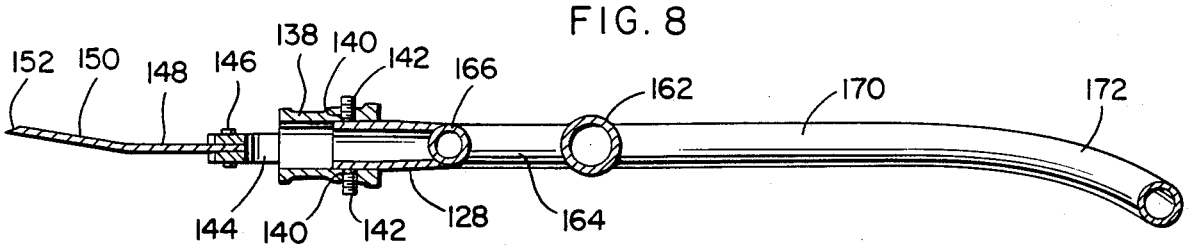
FIG. 8 is a longitudinal section taken along the line 8—8 of FIG. 7.
Figure 9:
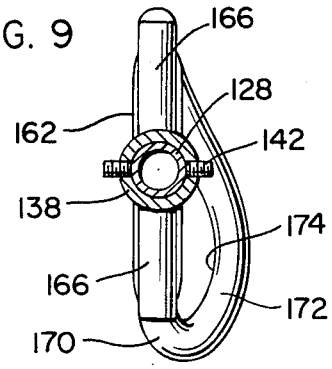
FIG. 9 is a cross-section as viewed along the line 9—9 of FIG. 7.
Figure 10:
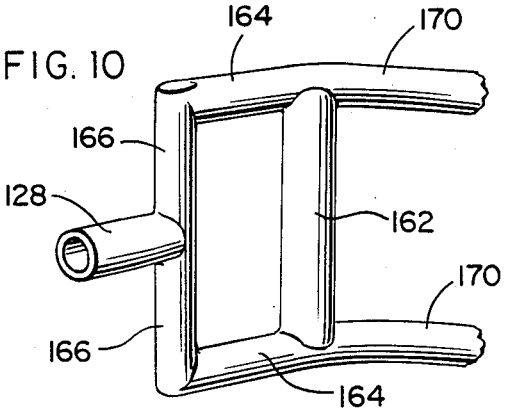
FIG. 10 is a perspective view, partly in section, of one end of the scraper extension bracket.

In FIG. 7, a tubular U-shaped member 168 extends from the hand grip bar 162. U-shaped member 168 includes two parallel legs 170, which extend at an approximate angle of 20° in a direction down and away from hand grip 162. Crosspiece 172, as shown in FIG. 8 and 9, curves away from the plane occupied by members 164, 166, and 170. The inclination of the crosspiece 172 with respect to the remainder of the scraper extension bracket 120 will be explained with reference to FIG. 6.

Figure 6:
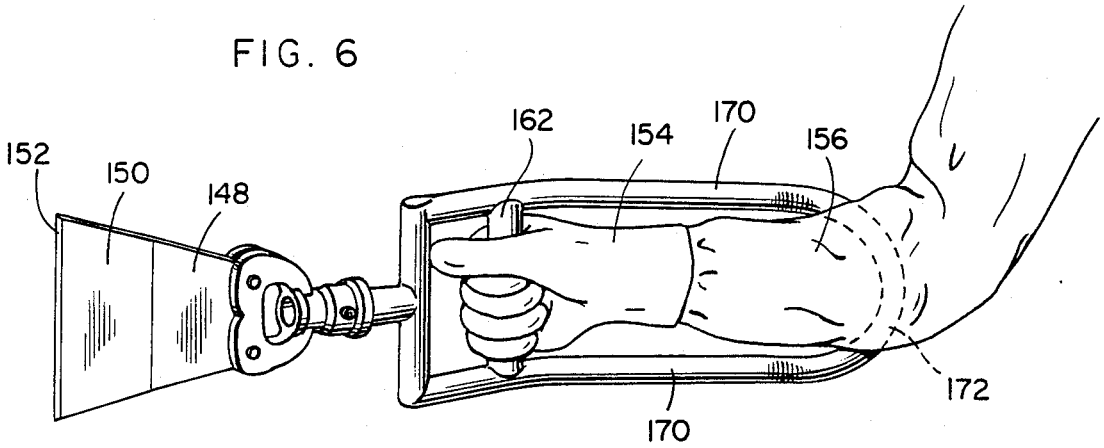
FIG. 6 is a front side elevation of an alternate embodiment of the asbestos scraper assembly.

In FIG. 6, a left-handed operator is shown holding the asbestos scraper assembly. When a right-handed operator holds the assembly, the assembly is reversed and legs 170 slope upwardly from crosspiece sections 164. The hand 154 cradles the hand grip bar 162 in the palm of the operator, and the operator's fingers are wrapped around the bar. The side surface 174 of the crosspiece 172 rests against the forearm 174 so as to firmly locate the scraper extension bracket against the forearm when scraping a flat wall surface. When the blade is advanced by the arm of the operator, the hand guides the positioning of the point of contact of the cutting edge 152 with the wall surface, and the forearm aids in accurately and forcibly guiding the scraper extension bracket.

In FIGS. 11 through 14, another embodiment of the asbestos scraper assembly is shown. Similar parts to those shown in FIGS. 1 through 5 are labeled with a prefix of 200.

In FIG. 13, a tubular straight shaft 276 is shown. One end 278 is riveted by rivet 280 to scraper clamp ring 238. Forearm cuff 284 is mounted at opposite end 282 of shaft 276. Cuff 284 is U-shaped and is secured by nut-and-bolt assemblies 286 to U-shaped bracket 288. Bracket 288 is secured to end 282 by a bolt 290 and nut 292. Bolt 290 extends through hollow shaft 276.

Hand grip 292 is mounted on a hollow shaft 294 through which extends bolt 296. Bolt 296 passes through hollow shaft 276 and is anchored on top of the shaft 276 by nut 298. Hand grip 292 is formed of a series of elastic rubber ribs which are compressible by hand pressure to form a tight grip when grabbed by a hand. The cuff 284 and bracket 288 are, like the grip 292, covered with an electrical insulating rubber coating to prevent electric shocks from being transmitted to the operator. Any other known electrical insulation may be used.

In operation, the asbestos scraper assembly 236 is guided by grabbing the grip 292 by the hand 254 of the operator. The cuff 284 fits over the forearm 256 of the operator so as to aid in supporting the asbestos scraper blade and guiding the cutting edge of the scraper blade as it is moved across a flat surface by the operator.

For left-handed operators, the nut 298 and nut 292 are loosened, and the grip 292 and cuff 284 are detached from the shaft 276. The grip and cuff are turned 180° and located on the opposite side of the shaft to that shown in the Figures and resecured to the shaft by tightening of the nuts 292 and 298. This assures the proper alignment of the cutting edge 252 of the scraper portion 250 to maximize scraping efficiency. Alternately, the rivet 280 could be replaced by a nut and bolt assembly for removal and reversal of the position of the scraping blade with respect to the grip and cuff for left-handed operators.

By the present invention, a comfortable gripping of an asbestos scraper extension is performed by the hand and forearm of an operator. The scraper blade is accurately positioned while being supported by the hand and forearm of the operator. The operator is thereby able to scrape flat wall surfaces for long periods of time without need for a rest.

Having described the invention, many modifications thereto will become apparent to those skilled in the art to which it pertains without deviating from the spirit of the invention, as defined by the scope of the appended claims.

What is claimed is:

1. A scraper assembly comprising:

a scraper blade for scraping a surface, said scraper blade including a first portion and a second portion, a support bracket extending longitudinally in a plane, said support bracket having two ends, means for mounting said first portion of said scraper blade on one end of said support bracket, said first portion extending in said plane of said support bracket, said second portion extending at an angle to said first portion, and the other end of said support bracket including means for engaging and being supported by the forearm of an operator so that upon forward motion of the arm of the operator at an angle to the surface being scraped, said second portion contacts and scrapes the surface.

2. A scraper assembly as in claim 1, wherein said support bracket includes a hand grip bar and at least one elongated member, said hand grip bar being mounted on said elongated member and extending transverse to said elongated member.

3. A scraper assembly as in claim 2, wherein said scraper blade means is rotatably mounted on said support bracket.

4. A scraper assembly as in claim 2, wherein said hand grip bar and said means for engaging and being supported by the forearm of an operator are removably mounted on said at least one elongated member.

5. A scraper assembly as in claim 2, wherein said means for engaging and being supported by the forearm of an operator is an annular ring through which the hand and forearm of the operator are inserted.

6. A scraper assembly as in claim 2, wherein said means for engaging and being supported by the forearm of an operator is the crosspiece of a U-shaped member, the legs of which form said at least one elongated member.

7. A scraper assembly as in claim 2, wherein said means for engaging and being supported by the forearm of an operator is a U-shaped cuff.

8. A scraper assembly for scraping an asbestos-containing covering of a surface, said scraper assembly comprising:

a scraper blade including a first portion and a second portion, a support bracket extending longitudinally in a plane, said support bracket having two ends, mounting means for mounting said first portion of said scraper blade on one end of said support bracket, said first portion extending in said plane of said support bracket and said second portion extending at an angle to said first portion, said support bracket including grip means for gripping of the support bracket by the hand of an operator and support means located at the other end of said bracket from said scraper blade for engaging and being supported by the forearm of an operator so that upon forward motion of the arm of the operator at an angle to the surface being scraped, said second portion contacts and scrapes the surface.

9. A scraper blade assembly as in claim 8, wherein said grip means and said support means are longitudinally spaced from each other.

10. A scraper blade assembly as in claim 8, wherein said grip means and said support means are removably mounted on said support bracket for removal and relocation to an opposite side of said support bracket.

11. A scraper blade assembly as in claim 8, wherein said support bracket includes parallel members interconnected by a curved crosspiece forming said support means.

12. A scraper blade assembly as in claim 8, wherein said support bracket includes parallel member interconnected by an annular ring forming said support means.

13. A scraper blade assembly as in claim 8, wherein said scraper blade is rotatably mounted on said support bracket.

14. A scraper assembly comprising:

scraper blade means for scraping a surface, a support bracket having two ends, means for mounting said scraper blade means on one end of said support bracket, and the other end of said support bracket including means for engaging and being supported by the forearm of an operator, said support bracket including a hand grip bar and at least one elongated member, said hand grip bar being mounted on said elongated member and extending transverse to said elongated member, said scraper blade means being rotatably mounted on said support bracket.

15. A scraper assembly as in claim 14, wherein said means for engaging and being supported by the forearm of an operator is an annular ring through which the hand and forearm of the operator are inserted.

16. A scraper assembly as in claim 14, wherein said means for engaging and being supported by the forearm of an operator is the crosspiece of a U-shaped member, the legs of which form said at least one elongated member.

17. A scraper assembly as in claim 14, wherein said scraper blade means includes a scraper blade, a portion of which is bent at an angle to another portion of said scraper blade means.

18. A scraper assembly for scraping an asbestos-containing covering of a surface, said scraper assembly comprising:

a scraper blade, a support bracket having two ends, and mounting means for mounting said scraper blade on one end of said support bracket, said support bracket including grip means for gripping of the support bracket by the hand of an operator and support means located at the other end of said bracket from said scraper blade for engaging and being supported by the forearm of an operator, said scraper blade being rotatably mounted on said one end of said support bracket.

19. A scraper blade assembly as in claim 18, wherein said grip means and said support means are longitudinally spaced from each other.

20. A scraper blade assembly as in claim 18, wherein said scraper blade includes a portion bent at an angle to another portion of said scraper blade.

* * * * *